US011952091B2

(12) United States Patent
Vogels

(10) Patent No.: US 11,952,091 B2
(45) Date of Patent: Apr. 9, 2024

(54) MARINE VESSEL PROPELLER, PROPELLER BLADE AND METHOD FOR INSTALLING THE MARINE VESSEL PROPELLER

(71) Applicant: Wärtsilä Norway AS, Rubbestadneset (NO)

(72) Inventor: Robert Vogels, DM Drunen (NL)

(73) Assignee: WÄRTSILÄ NORWAY AS, Rubbestadneset (NO)

( * ) Notice: Subject to any disclaimer, the term of this patent is extended or adjusted under 35 U.S.C. 154(b) by 121 days.

(21) Appl. No.: 17/689,224

(22) Filed: Mar. 8, 2022

(65) Prior Publication Data

US 2022/0185438 A1 Jun. 16, 2022

Related U.S. Application Data

(63) Continuation of application No. PCT/EP2019/073971, filed on Sep. 9, 2019.

(51) Int. Cl.
*B63H 1/20* (2006.01)

(52) U.S. Cl.
CPC ..... *B63H 1/20* (2013.01)

(58) Field of Classification Search
CPC ..... B63H 1/20; B63H 1/26
See application file for complete search history.

(56) References Cited

U.S. PATENT DOCUMENTS 1,634,330 A * 7/1927 Malm ..... B63H 1/20 416/208
2,892,503 A * 6/1959 Hood, Jr. ..... B63H 1/20 174/138 R (Continued)

FOREIGN PATENT DOCUMENTS

CN 106347612 A 1/2017
GB 1482375 A 8/1977

(Continued)

OTHER PUBLICATIONS

International Search Report (PCT/ISA/210) and Written Opinion (PCT/ISA/237) dated Apr. 20, 2020, by the European Patent Office as the International Searching Authority for International Application No. PCT/EP2019/073971.

*Primary Examiner* — Woody A Lee, Jr.
*Assistant Examiner* — Cameron A Corday
(74) *Attorney, Agent, or Firm* — BUCHANAN INGERSOLL & ROONEY PC

(57) ABSTRACT

A marine vessel propeller to convert engine rotational power into propulsive thrust is of a built-up propeller (BUP) type having a circular array of propeller blades, wherein each propeller blade is a single piece including a blade part and a base part. The base part has a generally circular inner surface with a number of radially extending cylindrical indents provided with planar end wall and fastening holes arranged through the base part at a location of the indents. A cylindrical insert is provided with a hole parallel to a longitudinal axis of the insert and arranged to fit into the indent, such that the propeller blades are attachable to a propeller shaft using exemplary fastening bolts through the fastening holes and inserts. A propeller blade and method for installing a marine vessel propeller are also disclosed.

16 Claims, 3 Drawing Sheets

(56) References Cited

U.S. PATENT DOCUMENTS

| | | | | | |
|---|---|---|---|---|---|
| 3,557,744 | A * | 1/1971 | Herbert | B63B 3/40 | 114/57 |
| 3,711,220 | A * | 1/1973 | Ramback | B63H 3/12 | 416/207 |
| 5,445,497 | A * | 8/1995 | Seemar | B63H 3/008 | 416/207 |
| 5,554,003 | A * | 9/1996 | Hall | B63J 3/04 | 416/131 |
| 6,352,410 | B1 * | 3/2002 | Muller | B63H 3/04 | 416/207 |
| 8,419,369 | B2 * | 4/2013 | Des Roches | F03B 3/128 | 416/219 R |

FOREIGN PATENT DOCUMENTS

| | | | |
|---|---|---|---|
| KR | 20150100016 | A | 9/2015 |
| KR | 20150100021 | A | 9/2015 |
| WO | 2018059198 | A1 | 4/2018 |

* cited by examiner

MARINE VESSEL PROPELLER, PROPELLER BLADE AND METHOD FOR INSTALLING THE MARINE VESSEL PROPELLER

RELATED APPLICATION

This application claims priority as a continuation application under 35 U.S.C. §120 to PCT/EP2019/073971 filed as an International Application on Sep. 9, 2019 designating the U.S., the entire content of which is hereby incorporated by reference in its entirety.

FIELD

The present disclosure relates to marine vessel propeller to convert an engine rotational power into a propulsive force. The present disclosure relates also to a propeller blade and method for installing the marine vessel propeller.

BACKGROUND INFORMATION

The present disclosure relates to a propulsion system for large marine vessels having engine power in a range from one megawatt up to tens of megawatts and propeller diameter from one meter up to ten meters. Each vessel's hull has its own characteristics. In order to achieve the highest possible overall efficiency of the vessel, the propeller must be perfectly matched with the engine and hull. Propeller design is always tailored to the specific application. There are three different basic type of propellers for these vessels, fixed pitch, controllable pitch and built-up propellers each having their own characteristics.

A fixed pitch propeller (FPP) is a preferred choice when optimum efficiency, reliability, robustness and low costs are required and when the operational parameters of the vessel are known in advance; i.e., when designing the vessel and the propeller. Fixed pitch propellers are usually installed for ocean going vessels, for example: container vessels, tankers, bulk carriers, dry cargo vessels and passenger liners. Manufacturing of a large diameter fixed pitch propeller is demanding and lead time to finish such a propeller is long.

Controllable pitch propeller (CPP) systems can provide excellent performance and manoeuvrability and are recommended for vessels with frequent sailing routes that involve multiple operating conditions. These can be, for example, vessels requiring full power in both bollard pull and free-sailing conditions, or that make frequent port calls. Controllable pitch propeller systems can also be applicable for vessels that encounter varying weather conditions or demanding operational requirements such as dynamic positioning. A controllable pitch propeller is often an optimal choice for installations with a shaft generator operating at constant rotational speed. Full propulsion power is avail able in both heavy and light conditions through an automatic pitch adjustment. Engine overload is avoided regardless of the conditions. The CPP is an ideal choice for diesel-mechanic propulsion with both medium-speed and low-speed diesel engines.

Built-up propeller (BUP) is basically a fixed pitch propeller (FPP) that is not a single piece; i.e., monobloc casting but with separate casted propeller blades bolted to a hub part. BUPs are an attractive alternative for monobloc fixed pitch propellers. A BUP includes blades that are connected towards the propeller shaft with a flange and fit bolts. Most BUPs for are delivered with 4- and 5-blades propellers, but 6-bladed propellers are also available. BUPs have, for example, been supplied in stainless steel or bronze. There are no particular production related propeller diameter or weight limits.

Built-up propellers have, for example, been installed on ice-breakers and offshore patrol vessels that operate in ice infested waters or operational areas with increased risk of propeller damage. As a damaged propeller needs to be repaired or even replaced, a BUP provides several advantages over a monobloc fixed pitch propeller. Naturally long interruption of the vessel operating is highly unwanted. Limited replacement time enables the vessel to maintain its schedule, which is beneficial for vessels with a fixed operating schedule such as cruise vessels and ferries.

A proper BUP design allows a single damaged BUP blade to be changed or demounted for repair. A possibility of under water (de)mounting enables the BUP blades to be replaced or repaired without long interruption to normal operating service. Underwater propeller blade installation and replacement allows faster vessel service since no dry-docking is needed. In case of propeller damage a single BUP blade is easier to transport and handle than a full sized monobloc fixed pitch propeller. A limited storage space is also involved because of spare blades. Even an on-board storage of spare blades is an option. These factors make a BUP a feasible alternative for propellers that suffers from frequent damage because of collisions.

Galvanic corrosion should be taken into consideration when designing products for marine use. Dissimilar metals and alloys have different electrode potentials, and when two or more come into contact in an electrolyte (sea water), one metal acts as anode and the other as cathode. The electropotential difference between reactions at the two electrodes is a driving force for an accelerated attack on the anode metal, which dissolves into the electrolyte. This leads to the metal at the anode corroding more quickly than it otherwise would and corrosion at the cathode being inhibited. The presence of an electrolyte and an electrical conducting path between the metals is essential for galvanic corrosion to occur. The electrolyte provides a means for ion migration whereby ions move to prevent charge build-up that would otherwise stop the reaction.

There are several ways of reducing and preventing galvanic corrosion. One option is to electrically insulate the two metals from each other. If they are not in electrical contact, no galvanic coupling will occur. This can be achieved by using non-conductive materials between metals of different electropotential. Components can be isolated with plastic materials or made of metal material internally coated or lined. Another option is to ensure that there is no contact with an electrolyte. This can be done by using water-repellent compounds such as greases, or by coating the metals with an impermeable protective layer, such as a suitable paint or plastic. If it is not possible to coat both, the coating should be applied to the more noble material with higher potential. This is advisable because if the coating is applied only on the more active material, in case of damage to the coating there will be a large cathode area and a very small anode area, and for the exposed anodic area the corrosion rate will be correspondingly high.

It may also be possible to choose metals that have similar electropotentials. The more closely matched the individual potentials, the smaller the potential difference and hence the smaller the galvanic current. Using the same metal for all construction is an easy way of matching potentials but it is also a more costly way. Electroplating or other plating can also help. This tends to use more noble metals that resist corrosion better. Chrome, nickel, silver and gold can all be used. Galvanizing with zinc protects a steel base metal by sacrificial anodic action.

Patent publication KR1020150100021A relates to a propeller fora ship. A plurality of blades composed of a composite material is inserted into a coupling portion of a hub composed of a metal material in advance of a separation preventing device inserted into the coupling portion of the hub. The blades and the separation preventing device are coupled to the coupling portion of the hub with a coupling bolt to allow for smoothly replacing only the damaged blade when the blade is damaged. According to an embodiment, a propeller for a ship includes: a hub having a '⊢'-shaped side surface, having a central inner hollow portion to be fixated to a driving shaft connected to an engine of the ship or a motor to integrally be rotated; blades coupled to the outside of protrusions of the hub in a radial direction to generate propulsion; a separation preventing device positioned to come in contact with one side surface of the blades coupled to an outside of the protrusions of the hub to prevent the blade from being separated from the hub; and a coupling bolt fixating the blades and the separation preventing device to integrally be connected to the hub.

Patent publication KR1020150100016A relates to a hubless propeller. The propeller includes: a propeller wing module where one propeller wing is formed in an integrated coupling unit of a divided hub structure; and a coupling ring formed on a center region of a shaft to be coupled and separated from a lower end protrusion of the propeller wing module. The propeller wing module is formed by a same number of the divided hub to be coupled and separated from the shaft, thus the propeller wing module where the existing propeller wing and the hub are integrally formed is easily coupled and separated from the shaft to easily be processed. Moreover, the propeller wing module can be used to easily process an entire propeller, and more easily replace the propeller when a specific propeller wing is damaged.

Patent publication CN106347612 A (WO2018059198A1) discloses a ship detachable ship propeller, which addresses a technical problem that the propeller maintenance and repair is inconvenient, time-consuming and labor intensive, and high in cost. A detachable ship propeller includes a hub 2 and a blade 1. The bottom end of the blade 1 is connected with an arc-shaped mounting plate 3, and the mounting plate 3 is provided. The hub 2 is provided with a plurality of slots 6 disposed opposite to a plurality of mounting holes 5, and the mounting holes 5 and the slots 6 are attached with bolts 4. The blade 1 and the mounting plate 3 are integrally formed, adopting casting molding, for convenience in production and manufacture, simple in process and high in efficiency, and at the same time, the joint cost of the two is better, and breakage or looseness between the blade 1 and the mounting plate 3 is reduced and/or avoided. The phenomenon is obtained to ensure normal use of the blade 1. A width of the mounting plate 3 is a same as a width of the hub 2, and long sides of the adjacent two mounting plates 3 are butted to each other. The edges of the adjacent mounting plates 3 are butted, wherein the mounting plate 3 has an arc-shaped structure, and the plurality of mounting plates 3 are spliced into a cylindrical structure surrounding the periphery of the hub 2. It is a split structure, but after the mounting plate 3 is spliced with the hub 2, it still forms a complete structure, which is easy to install, and there is no gap after installation. The connecting end of the blade 1 and the mounting plate 3 is disposed in the middle of the mounting plate 3, and a plurality of mounting holes 5 on both sides of the blade 1 are symmetrically disposed. A mutual force is generated between the blade 1 and the water, and the corresponding force acts on the mounting plate 3 through the blade 1.

Since the blade 1 and the hub 2 are in a separate structure, the mounting plate 3 and the hub 2 are in the split structure, the blade 1 is placed in the middle position, and the force of the blade 1 on the mounting plate 3 is uniform. Correspondingly, symmetrical mounting holes 5 are fixed on the mounting plates 3 on both sides of the blade 1 to avoid damage caused by excessive partial force of the mounting plate 3, and the service life of the blades 1 is longer. The mounting plate 3 can be provided with mounting holes 5 at the edges thereof, and the mounting holes 5 at the edges of the mounting plate 3 are evenly distributed. The blade 1 is inclined at the middle of the mounting plate 3, and the mounting plate 3 is divided into approximately two triangular regions by the blade 1, and corresponding mounting holes 5 are provided at the edges in the triangular region, and mounting holes 5 are also provided in the middle portion. In this form, the mounting plate 3 can be fixed more firmly. In a specific operational method, when the blade 1 is worn, needs to be repaired or replaced, the ballast water is adjusted to make the ship have sufficient trim to locate the propeller out of the water surface. At this time, a maintenance and repair operation can be performed, and the corresponding blade is removed. The bolt 4 of blade 1 separates the blade 1 from the hub 2, and the worker repairs the blade 1 or replaces the new blade 1.

Patent document JP1979070590A discloses a mount section 11 for a propeller blade 2 is formed integral at one end of a propeller shaft 4 connected to the main engine 10 through a coupling 7 and an intermediate shaft 8. On a circumference of the mount section 11, a plurality of propeller blades 2 are planted and fixed with a bolt 12, while a propeller cap 3 is mounted to the end of the mount section 11 with a bolt 13. In addition, the periphery of the mount section 11 is provided with an anti-corrosion metal 14 and a coating material 15. With such an arrangement, even after a ladder 1 is installed, the propeller blades can be mounted to the section 11 with ease. With the driving of the main engine, the propeller blades are rotated to propel the ship.

Patent publication GB1482375 discloses a marine propeller assembly including a shaft having formed integrally with it a hollow cylindrical hub for attachment of separate propeller-blades, which have palms seated on an external surface of the hub and which are attached by bolts or studs extending through the hub into the palms and secured from inside the former. The palms may be seated on a cylindrical external surface of the hub or on flats provided on the external surface of the hub. The studs 5 are passed from inside the hub 2 through plain holes 6 in the hub wall and are screwed into holes 7 in the palm 3. Protection of the steel hub 2 against sea water is provided by an annular plate 13 secured to the forward ends of the palms 3 and having a collar 14 engaged over the adjacent end portion, itself provided with a protective covering 15, of the hollow shaft 1, and by a circular plate 16 secured to the after end of the hub 2. The parts 13-16 are made of a corrosion-resistant material, such as manganese aluminium bronze. Gaps 17 left between the palms 3 are sealed by corrosion-resistant sealing strips 18 inserted in recesses 19 in or below the gaps. A filling compound, for example polystyrene, is injected below the strips and into the lower port of the gaps to seal off the hub 2 and studs 5 from the water. Holes 20 closed by plugs 21 and serving for the pumping in of the compound are then covered by the plate 16. The gaps 17 themselves may also be filled to maintain the hub profile.

Thus, the state of the art reflects attention toward a potential of the BUP design. However, known BUP designs have some disadvantages in comparison to fixed pitch propellers (FPP). One is a potentially higher cost due to an increased number and more expensive parts. Another unsolved disadvantage is a lower hydrodynamic efficiency due to a bigger hub design needed for attachment of the blades. The present disclosure is directed to improving the BUP design on these points, such that a BUP could be a preferred choice over a FPP in many cases.

SUMMARY

A marine vessel propeller is disclosed to convert engine rotational power into propulsive thrust when in use, wherein the propeller comprises: a built-up propeller (BUP) type circular array of propeller blades, wherein each propeller blade is a single piece having a blade part and a base part, the base part having a generally circular inner surface in which there is arranged a number of radially extending cylindrical indents provided with planar end wall and fastening holes arranged through the base part at a location of the indents; and a plurality of cylindrical inserts, each provided with a hole parallel to a longitudinal axis of the insert and arranged to fit into one of the indents, the propeller blades being configured to be attachable to a propeller shaft by fastening bolts through the fastening holes and inserts.

A method is also disclosed for installing a marine vessel propeller of a built-up propeller (BUP) type circular array of propeller blades, wherein each propeller blade is a single piece having a blade part and a base part, the base part having a generally circular inner surface in which there is arranged a number of radially extending cylindrical indents provided with planar end wall and fastening holes arranged through the base part at a location of the indents; and a plurality of cylindrical inserts each provided with a hole parallel to a longitudinal axis of the insert and arranged to fit into one of the indents, the propeller blades being configured to be attachable to a propeller shaft by fastening bolts through the fastening holes and inserts, wherein the method comprises: providing a propeller shaft including planar indents on the shaft; installing the inserts into the indents and fixing the indents to the shaft; forming a corrosion protective insulation on a remaining exposed shaft outer surface; and attaching one propeller blade at the time into position by tightening the fastening bolts.

BRIEF DESCRIPTION OF DRAWINGS

In the following, the invention will be described with reference to the accompanying schematic drawings of exemplary embodiments, in which.

DETAILED DESCRIPTION

Figure 1:
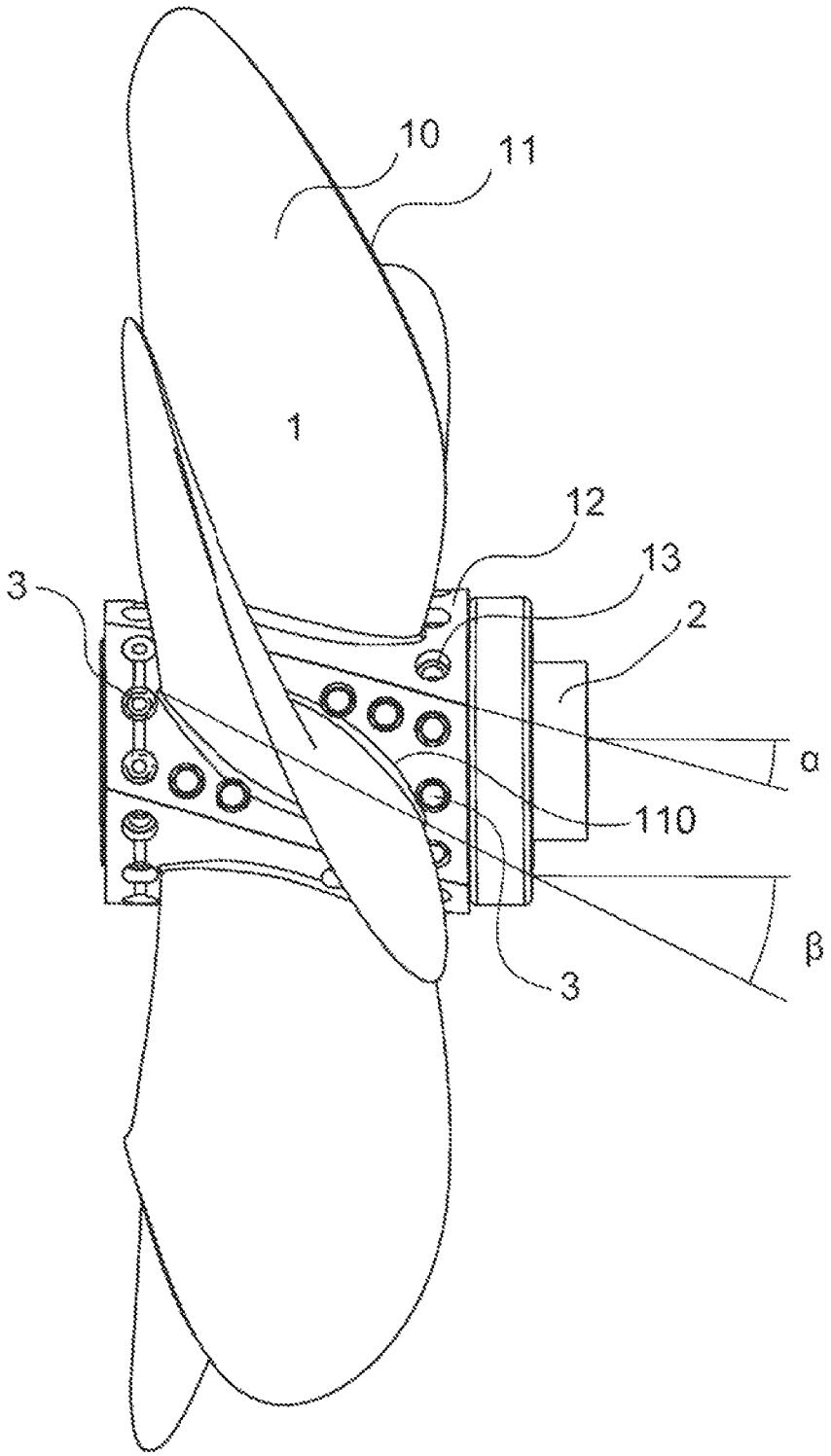
FIG. 1 illustrates a marine vessel propeller according to an exemplary embodiment of the disclosure.

A marine vessel propeller is disclosed herein which can convert an engine rotational power into a propulsive thrust when in use, wherein the propeller is of a built-up type BUP with attachable/detachable propeller blades. A BUP as disclosed can have improved power transmission capability in a relatively slim hub design to improve hydrodynamic efficiency. Further, a BUP as disclosed can have improved corrosion resistance. A BUP as disclosed can be relatively inexpensive to manufacture, and the performance can be considerably improved compared to known solutions.

An exemplary embodiment of a marine vessel propeller as disclosed can convert engine rotational power into propulsive thrust when in use, wherein the propeller is of a built-up propeller (BUP) type having a circular array of propeller blades, wherein each propeller blade is a single piece including a blade part and a base part. The base part can have a generally circular inner surface in which there is arranged a number of radially extending cylindrical indents provided with planar end wall and fastening holes arranged through the base part at the location of the indents. A cylindrical insert is provided with a hole parallel to a longitudinal axis of the insert and arranged to fit into the indent, such that the propeller blades are attachable to a propeller shaft by means of, for example, fastening bolts through the fastening bolt holes and inserts.

An exemplary embodiment enables the propeller blades to be attached to a propeller shaft in such a way that combined base part and propeller shaft combination (i.e., parts corresponding to a known hub), has a relatively compact diameter corresponding to a power transmission capability and has a streamlined and flush outer contour. This can provide better hydrodynamic efficiency.

Furthermore, as the propeller is of a built-up propeller (BUP) type having a circular array of propeller blades, the circular array can be most suitably divided in segments to match to a designed number of propeller blades, such as for example, four, five or six blades corresponding 90 degrees, 72 degrees or 60 degrees segments. The propeller blade is a single piece including a blade part and a base part, for example, made of a cast metal such as stainless steel or bronze.

The propeller blade base part can have a generally circular inner surface. This feature has an effect to the overall design of the hub. The propeller shaft may be made circular and relatively small in diameter while the base part has even thickness that is beneficial in giving good strength properties within compact dimensions especially when done as a cast piece. The inner surface of the base part is, for example, intended not to be in direct contact with the propeller shaft when assembled but all contact is established via inserts. This enables conformal protective coating against corrosion, especially galvanic corrosion if the propeller blade and propeller shaft are of different material having different electropotential.

According to an exemplary embodiment the base part has a number of radially extending cylindrical indents provided with planar end wall and fastening holes arranged through the base part at the location of the indents. These indents form the support and base of the propeller blade when fastened to the propeller shaft. The indents size together with positioning and number, are arranged, configured and designed so that the surface area of the planar end wall provides enough area, when fastening bolts properly tightened, to bear all the load the engine delivers with a safety margin, for example to bear the load of propeller hitting an ice floe.

The inserts fitted into the indents are arranged to bear the fastening bolt tensioning load between the base part and the propeller shaft. The insert has cylindrical overall shape, through-hole for fastening bolt and two parallel planes defining the insert thickness that defines a clearance between the base part inner surface and the propeller shaft when tightened for use. Thus the thickness of the insert is designed to be greater than the distance between the planar end walls of indents in the base part and in the propeller shaft (if the propeller blade is put on its position without inserts). It is intended to create a clearance between the base part inner surface and the propeller shaft outer surface. This enables use of soft materials such as polymer coatings or layers as a corrosion protection layer because the corrosion protection layer does not participate in delivering the forces between the propeller shaft and the blade. The contact and load delivery from the propeller shaft though cylindrical inserts to the base part and further to the blade part (and ending to the water) can be very accurate due solid construction and even possible to calculate accurately in strength sense.

This provides a marine vessel propeller in which performance is considerably improved in terms of power transmission, corrosion resistance and manufacturability.

The exemplary embodiments presented in this patent application are not to be interpreted to pose limitations to the applicability of novel features disclosed herein. The verb "to comprise" is used in this patent application as an open limitation that does not exclude the existence of also unrecited features. The features disclosed herein are mutually freely combinable unless otherwise explicitly stated. .

FIG. 1 depicts schematically an exemplary marine vessel propeller 1 to convert engine rotational power into propulsive thrust when in use, wherein the propeller is of a built-up propeller (BUP) type arranged in a circular array of propeller blades 10, such as four, five or six propeller blades forming the array, wherein the propeller blade 10 is a single piece including a blade part 11 and a base part 12. In this embodiment the propeller blade 10 base part 12 is slanted in a slant angle $\alpha$ in axial direction of the propeller shaft 2 so that the foot of the blade part 110 configured in a pitch angle $\beta$ in relation to the axial direction of the propeller shaft 2 fits on the outer surface of the base part 12. The propeller blades 10 are attachable to a propeller shaft 2 by means of fastening bolts 3 or other similar fasteners through the fastening holes 13.

Figure 2:
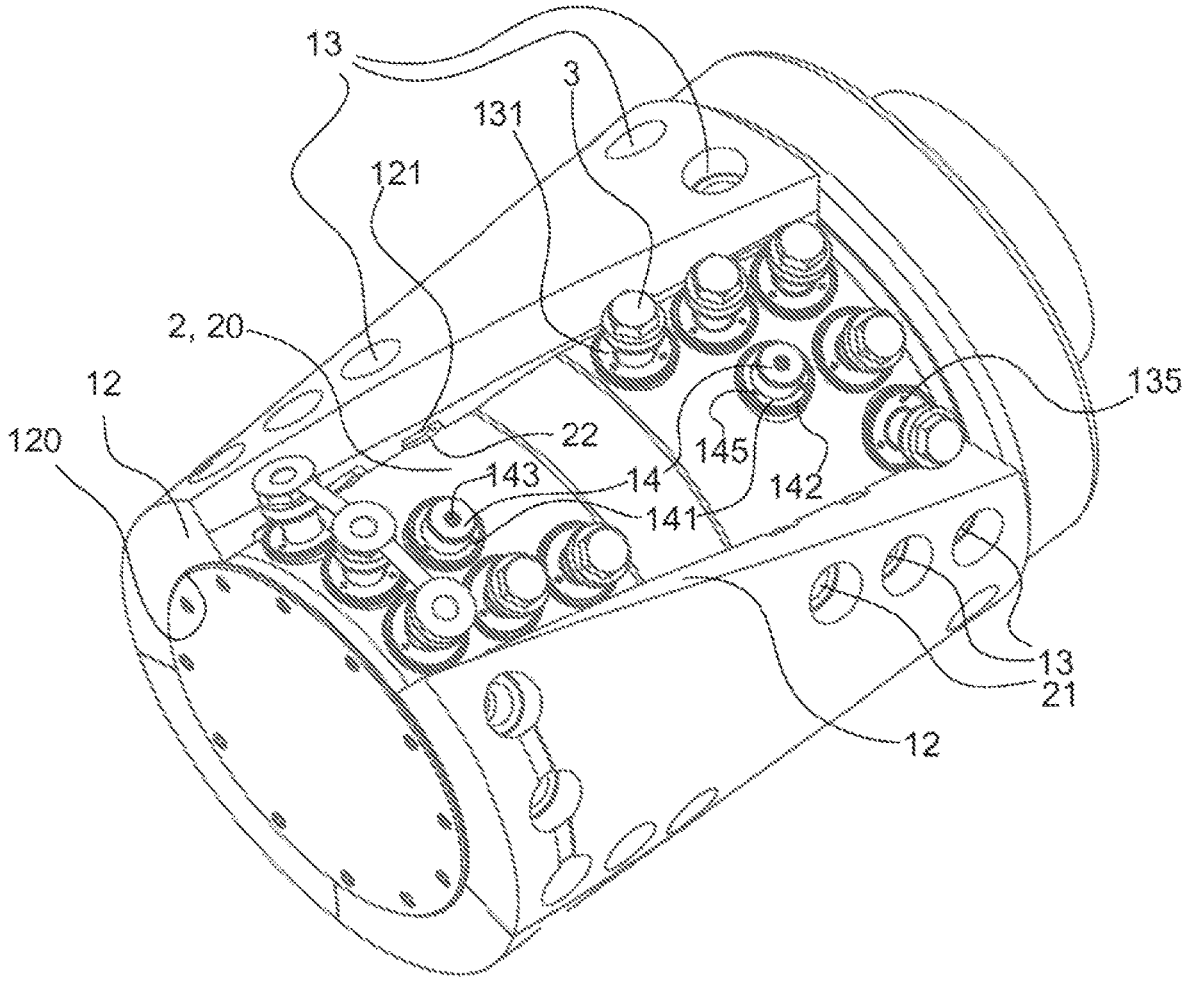
FIG. 2 illustrates an assembly of marine vessel propeller according to another exemplary embodiment disclosed herein; and, FIG. 3 illustrates details of an exemplary fastening arrangement in a marine vessel propeller according to still another exemplary embodiment as disclosed herein.

In FIG. 2, an exemplary embodiment of an internal construction is disclosed wherein one propeller blade, its base part and all blade parts are not shown to improve the view and clarity of the illustrated embodiment. Instead of the base part, there is shown one exemplary embodiment of attachment means. The base part 12 has a generally circular inner surface 120 in which there is arranged a number of radially extending cylindrical indents 121 provided with planar end wall and fastening holes 13 arranged through the base part 12 at the location of the indents 121. A cylindrical insert 131 is provided with a hole parallel to a longitudinal axis of the insert 131 and arranged to fit into the indent 121, such that the propeller blades 10 are attachable to a propeller shaft 2 by means of the exemplary fastening bolts 3 through the fastening holes 13 and inserts 131. The inserts may be attached to the shaft 2 (or to the base part 12) with attaching screws 135 or corresponding means.

In the FIG. 2 exemplary embodiment each propeller blade 10 is configured to receive at least two dowels 14, one by a rear part of the base part 12 and one by a front part of the base part 12. The dowels 14 are configured and arranged parallel to each other to define the mounting direction of the propeller blade 10 for assembly. Furthermore, each dowel 14 is provided with a dowel insert 141 to disconnect an anode/cathode-coupling between the propeller shaft 2 and the base part 12 by providing a sealing 142 disconnecting the propeller shaft outer surface 20 and inner surface 120 of said base part 12. The sealing 142 also protects the dowel 14 from sea water contact.

Figure 3:
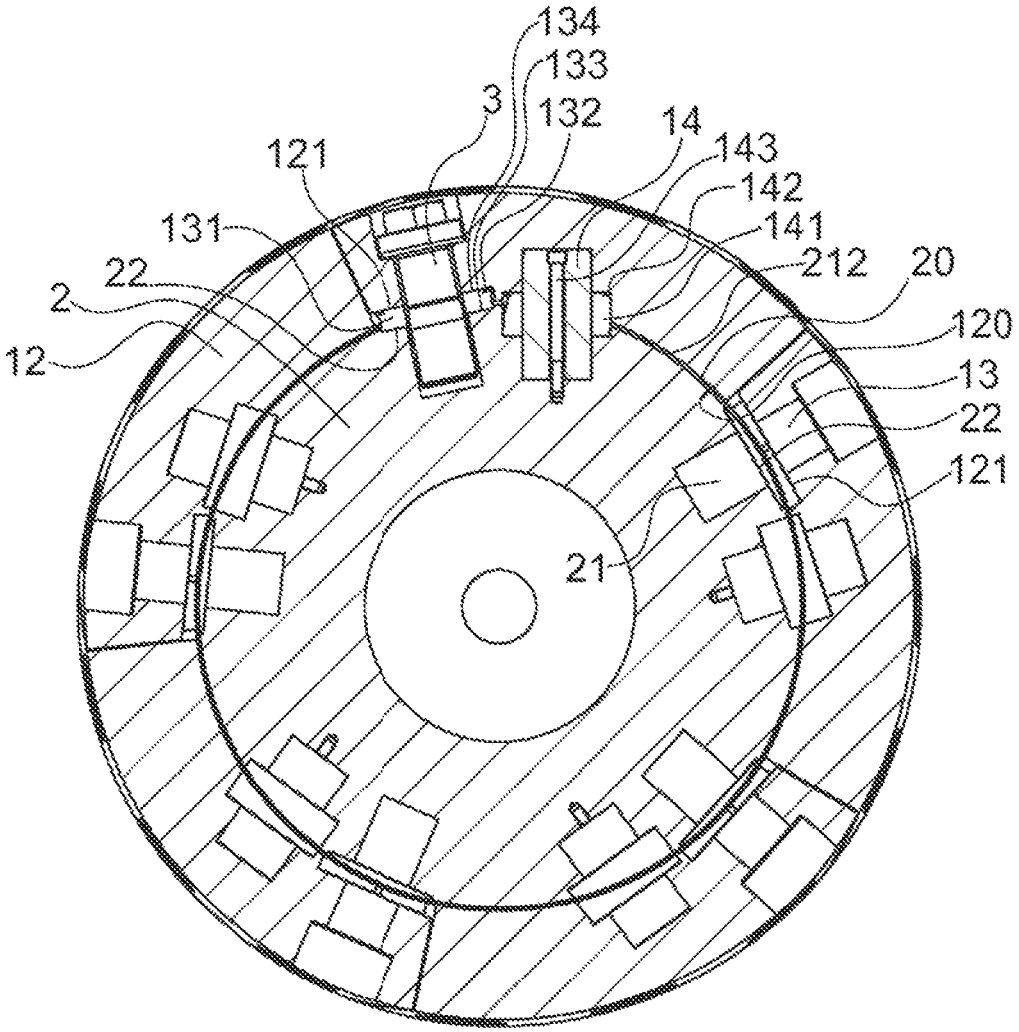

FIG. 3 illustrates a cross sectional view of an exemplary propeller embodiment that is of a built-up propeller (BUP) type arranged in a circular array of propeller blades 10. Here five propeller blades (only base parts 12 shown in FIG. 3) form the array. The base part 12 has a generally circular inner surface 120 in which there is arranged a number of radially extending cylindrical indents 121 provided with planar end wall and fastening holes 13 arranged through the base part 12 at the location of the indents 121. A cylindrical insert 131 is provided with a hole parallel to a longitudinal axis of the insert 131 and arranged to fit into the indent 121, such that the propeller blades 10 are attachable to a propeller shaft 2 by means of exemplary fastening bolts 3 through the fastening holes 13 and inserts 131. The exemplary insert 131 has cylindrical overall shape, through-hole for a fastening bolt 3 and two parallel planes 133, 134 defining the insert 131 thickness that defines a clearance 212 between the base part 12 inner surface 120 and the propeller shaft 2 when tightened for use. The inserts 131 are arranged to bear the fastening bolt 3 tensioning load between the base part 10 and the propeller shaft 2. The base part 12 planar indents 121 are perpendicular to radial direction of the circular inner surface 120. When assembling the propeller blade, it is easiest if the insert 131 is fit to be received and for example, attached on a planar indent 22 of the shaft 2 and the propelled blade is moved only as such. In exemplary embodiments, the dowels are fastened to the propeller shaft 2 with suitable dowel fastener 143, such as a bolt or other similar means.

As presented in FIG. 3, in addition to the load bearing function of the insert 131 it may also have another function. The insert 131 is arranged to disconnect an anode/cathode-coupling between the propeller shaft 2 and the base part 10 of the propeller blade by providing a sealing 132 disconnecting the surfaces 20 of said shaft 2 and inner surface 120 of said base part 12. Furthermore, by using inserts 131 that bear all forces between the shaft 2 and the propeller blade 10, the propeller shaft 2 may be provided with a coating to disconnect an anode/cathode-coupling between the propeller shaft 2 and the propeller blade 10. The clearance 212 between the base part 12 inner surface 120 and the propeller shaft 2 is the available space for a coating to disconnect an anode/cathode-coupling between the propeller shaft 2 and the propeller blade 10 by preventing the contact of seawater to the shaft 2. Indeed, the base part 12 inner surface 120 is isolated from galvanic connection to the propeller shaft 2. There is a desire and need for a protective coating that will last years in a marine environment, at least 5 years, preferably 15 years or a lifetime. The presently known protective coatings to fulfil this requirement are relatively "soft". An exemplary solution is provided by a combination of the inserts and a simple soft protective coating, whereby the inserts take away any requirements with respect to load carrying from the protective coating. The exemplary design described here is not limited to hard protective coatings (e.g. sprayed polyurethane, epoxy or electroplating) that are capable of carrying the load between the vessel engine and the propeller blade, but one can also use softer corrosion resistant coatings that provide longer protection. Naturally this is more relevant when the propeller blade 10 material is not the same material as the shaft 2 and these may form an anode/cathode pair. With a marine vessel propeller in seawater it will practically always have to deal with more noble materials and less noble materials (i.e., those having different electropotential). In a normal case the propeller shaft is the less noble material which needs to be protected by a corrosion resistant coating to protect it from galvanic corrosion.

The sealing 132 of the insert 131 also protects the bolts 3, especially the stressed parts of bolts 3, such as the bolt's shank, from a potential stress corrosion fatigue caused by combination of seawater and propellers continuous bending forces and stress induced by vibrations. Each exemplary dowel 14 is also provided with a dowel insert 141 to disconnect an anode/cathode-coupling between the propeller shaft 2 and the base part 12 by providing a sealing 142 disconnecting the propeller shaft outer surface 20 and inner surface 120 of the base part 12. The shaft 2 rear and front parts that are not in connection with or in vicinity of the propeller parts, can be protected by known means such as rings, plates and caps equipped with seals, and the like.

FIG. 3 also presents an exemplary embodiment where the base part 12 includes planar indents 121 to receive the inserts 131 and the dowel inserts 141, the indents 121 are bevelled so that the propeller blade 10 can be brought to its mounted position from one direction for tightening. As presented in the FIG. 3, an exemplary embodiment includes fastening bolts in a radial direction of the propeller shaft, but the dowels are necessarily not. The dowels are set in the mounting direction that is depending on the base part 12 slant angle $\alpha$, as the propeller blade 10 base part 12 may be slanted in a slant angle $\alpha$ in axial direction.

The exemplary marine vessel propeller may be installed into position according to the following exemplary procedure. A method for installing the marine vessel propeller of a BUP type, includes:

providing a propeller shaft including planar indents on the shaft;

installing the inserts into the indents and fixing the inserts to the shaft for example by means of attaching screws;

forming a corrosion protective insulation on the remaining exposed shaft outer surface; and attaching one propeller blade at the time to its position and tightening the fastening bolts.

The dowels 14 and dowel inserts 141 are, for example, installed at a same time as the inserts 131. At the same time the dowels 14 and dowel inserts 141 are also fastened to the shaft 2 by fasteners such as screws 143. Also dowel inserts 141 may be fastened with fasteners 145, such as screws. Then dowels 14 and dowel inserts 141 are also installed and fastened to the shaft 2 prior forming a protective insulation. Thus the insulation is for example, attached to the shaft 2 before installing the propeller blades 10 but after installing the inserts and optionally the dowels. This can make the propeller blade installation as easy as possible and still enable very good corrosion protection to the shaft 2.

While the invention has been described herein by way of examples in connection with what are, at present, considered to be the most preferred exemplary embodiments, it is to be understood that the invention is not limited to the disclosed embodiments, but is intended to cover various combinations or modifications of its features.

The details mentioned in connection with any embodiment above may be used in connection with any other embodiment when such combination is technically feasible.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

Elements used in Figures:

1 propeller
10propeller blade
11 blade part
110 foot of the blade part
12 base part
120 base part inner surface
121 base indent
13 fastening hole
131 insert
132 insert sealing
133 insert plane
134 insert plane
135 insert attaching screw
14 dowel
141 dowel insert
142 dowel sealing
143 dowel fastener
145 dowel insert fastener
2 propeller shaft
20 propeller shaft outer surface
21 fastening bolt hole
22 indent for insert
212 clearance
3 fastening bolt

The invention claimed is:

1. A marine vessel propeller to convert engine rotational power into propulsive thrust when in use, wherein the propeller comprises:

a built-up propeller (BUP) type circular array of propeller blades, wherein each propeller blade is a single piece having a blade part and a base part, the base part having a generally circular inner surface in which there is arranged a number of radially extending cylindrical indents provided with planar end wall and fastening holes arranged through the base part at a location of the cylindrical indents; and a plurality of cylindrical inserts, each cylindrical insert provided with a hole parallel to a longitudinal axis of the cylindrical insert and arranged to fit into one of the cylindrical indents, the propeller blades being configured to be attachable to a propeller shaft by at least one fastening bolts;

wherein each cylindrical insert has two parallel planes defining a cylindrical insert thickness configured to define a clearance between the base part inner surface and the propeller shaft when tightened for use.

2. The marine vessel propeller according to claim 1, wherein the cylindrical inserts are configured and arranged to bear a fastening bolt tensioning load between the base part and the propeller shaft.

3. A marine vessel propeller according to claim 1, wherein each cylindrical insert has a through-hole for a fastening bolt.

4. The marine vessel propeller according to claim 1, wherein the cylindrical indents are perpendicular to a radial direction of the circular inner surface.

5. The marine vessel propeller according to claim 1, wherein each cylindrical insert is configured and fit to be received and attached on a planar indent of the propeller shaft.

6. The marine vessel propeller according to claim 1, in combination with thea propeller shaft, wherein each cylindrical insert is configured and arranged to disconnect an anode/cathode-coupling between the propeller shaft and the base part of the propeller blade by providing a sealing disconnecting surfaces of the propeller shaft and an inner surface of said base part.

7. The marine vessel propeller according to claim 1, in combination with a propeller shaft, wherein the base part inner surface is isolated from galvanic connection to the propeller shaft.

8. The marine vessel propeller according to claim 1, in combination with the propeller shaft, wherein the propeller blade base part is slanted in a slant angle (α) in an axial direction of the propeller shaft so that a foot of the blade part configured in a pitch angle (β) in relation to the axial direction of the propeller shaft fits on an outer surface of the base part.

9. The marine vessel propeller according to claim 1, wherein each propeller blade is configured to receive at least two dowels, one by a rear part of the base part and one by a front part of the base part, the dowels being arranged parallel to each other to define a mounting direction of the propeller blade for assembly.

10. The marine vessel propeller according to claim 9, in combination with the propeller shaft, wherein each dowel is provided with a dowel insert configured to disconnect an anode/cathode-coupling between the propeller shaft and the base part by providing a sealing disconnecting a propeller shaft outer surface and an inner surface of said base part.

11. The marine vessel propeller according to claim 7, wherein the propeller shaft is provided with an electrically insulating coating to disconnect an anode/cathode-coupling between the propeller shaft and the propeller blade by providing a sealing disconnecting a propeller shaft outer surface and an inner surface of said base part.

12. A marine vessel propeller blade for thea marine vessel propeller of claim 1, wherein the base part comprises:

planar indents to receive the cylindrical inserts and dowel inserts.

13. A marine vessel propeller blade for the marine vessel propeller of claim 1, wherein the propeller blade base part is slanted in a slant angle (α) in an axial direction.

14. A method for installing a marine vessel propeller of a built-up propeller (BUP) type circular array of propeller blades, wherein each propeller blade is a single piece having a blade part and a base part, the base part having a generally circular inner surface in which there is arranged a number of radially extending cylindrical indents provided with planar end wall and fastening holes arranged through the base part at a location of the cylindrical indents; and a plurality of cylindrical inserts each cylindrical insert provided with a hole parallel to a longitudinal axis of the cylindrical insert and arranged to fit into one of the cylindrical indents, the propeller blades being configured to be attachable to a propeller shaft by at least one fastening bolt, wherein each cylindrical insert has two parallel planes defining a cylindrical insert thickness configured to define a clearance between the base part inner surface and the propeller shaft when tightened for use, wherein the method comprises:

providing the propeller shaft including planar indents on the propeller shaft;

installing the cylindrical inserts into the cylindrical indents and fixing the cylindrical indents to the propeller shaft;

forming a corrosion protective insulation on a remaining exposed propeller shaft outer surface; and attaching one propeller blade at a time into position by tightening the at least one fastening bolts.

15. The method according to the claim 14, comprising:

installing and fastening dowels and dowel inserts to the propeller shaft prior to forming the protective insulation.

16. The method according to claim 15, wherein the installing and fastening comprises:

tightening insert attaching screws to fix the inserts to the propeller shafts.

* * * * *